US007909297B1

(12) United States Patent
Harris et al.

(10) Patent No.: US 7,909,297 B1
(45) Date of Patent: Mar. 22, 2011

(54) FLEXIBLE, LOW-PROFILE HARDWARE FOR MOUNTING NON-LINEAR STRUCTURES

(75) Inventors: Bryan K. Harris, Sandy, UT (US); Guillaume Martin, Villecresnes (FR)

(73) Assignee: 3form, Inc., Salt Lake City, UT (US)

( * ) Notice: Subject to any disclaimer, the term of this patent is extended or adjusted under 35 U.S.C. 154(b) by 568 days.

(21) Appl. No.: 11/829,810

(22) Filed: Jul. 27, 2007

Related U.S. Application Data

(60) Provisional application No. 60/820,752, filed on Jul. 28, 2006.

(51) Int. Cl.
*F21V 35/00* (2006.01)

(52) U.S. Cl. ..... 248/222.11; 248/220.21; 248/291.1

(58) Field of Classification Search ..... 248/220.21, 248/222.11, 291.1, 292.11, 292.13, 294.1; 52/235, 768, 769, 506.05
See application file for complete search history.

(56) References Cited

U.S. PATENT DOCUMENTS

| | | | | | |
|---|---|---|---|---|---|
| 1,724,433 | A | * | 8/1929 | Simon | 248/292.13 |
| 2,662,717 | A | * | 12/1953 | Johnson | 248/292.13 |
| 2,895,702 | A | * | 7/1959 | Pierce | 248/285.1 |
| 3,096,063 | A | * | 7/1963 | Nygren | 248/292.13 |
| 4,508,259 | A | * | 4/1985 | Hicks | 232/17 |
| 4,667,915 | A | * | 5/1987 | Boucher et al. | 248/292.13 |

* cited by examiner

*Primary Examiner* — Amy J Sterling
(74) *Attorney, Agent, or Firm* — Workman Nydegger

(57) ABSTRACT

Flexible mounting brackets and support structures can be used to mount substantially linear panels to substantially non-linear support structures without undue stress. For example, at least one implementation comprises a flexible mounting bracket having an attachment interface located on a proximal portion of the bracket, and a mounting interface on a distal portion of the bracket. The proximal and distal portions of the bracket are pivotally connected with one or more torsion springs, so that the proximal and distal portions can move or otherwise adjust to accommodate any stressing. A system for creating a nonlinear support structure thus includes the flexible mounting bracket, as well as vertical support structure components that can be configured to maintain a non-linear shape. Panels mounted to a plurality of flexible brackets maintain the non-linear shape of the support structure components without undue stress or damage.

18 Claims, 6 Drawing Sheets

FLEXIBLE, LOW-PROFILE HARDWARE FOR MOUNTING NON-LINEAR STRUCTURES

CROSS-REFERENCE TO RELATED APPLICATIONS

The present invention claims the benefit of priority to U.S. Provisional Patent Application No. 60/820,752, filed on Jul. 28, 2006, entitled "LOW-PROFILE HARDWARE FOR MOUNTING PANELS TO NON-LINEAR SUPPORT STRUCTURES," the entire contents of which are incorporated herein by reference.

BACKGROUND OF THE INVENTION

1. The Field of the Invention

Implementations of the present invention relate to hardware for mounting panels for use in decorative and/or structural architectural applications.

2. Background and Relevant Art

Some recent architectural designs have implemented synthetic, polymeric resins, which can be used as partitions, walls, décor, etc., in offices and homes. Present polymeric resin materials generally used for creating these resin panels comprise polyvinyl chloride or "PVC"; polyacrylate materials such as acrylic, and poly (methylmethacrylate) or "PMMA"; polyester materials such as poly (ethylene-co-cyclohexane 1,4-dimethanol terephthalate), or "PET"; poly (ethylene-co-cyclohexane 1,4-dimethanol terephthalate glycol) or "PETG"; glycol modified polycyclohexylenedimethlene terephthalate; or "PCTG"; as well as polycarbonate materials.

In general, resin materials such as these are now popular compared with decorative cast or laminated glass materials, since resin materials can be manufactured to be more resilient and to have a similar transparent, translucent, or colored appearance as cast or laminated glass, but with less cost. Decorative resins can also provide more flexibility, compared with glass, in terms of color, degree of texture, gauge, and impact resistance. Furthermore, decorative resins have a fairly wide utility at least in part since they can be formed to include a large variety of artistic colors, images, and can be further formed or otherwise mounted in a range of different shapes.

For example, resin materials can be formed for flat or three-dimensional (i.e., curved) formations, such as with compound curvatures. In addition, the flexibility of resin materials allows relatively flat resin panels to be mounted against a curved support structure for similar curvature effects. The resulting curved panels (whether via forming or mounting processes) can then be used in a wide range of decorative architectural applications, such as when assembling a new wall or ceiling, or when preparing a treatment thereto.

Mounting a curved resin panel as part of a curved structure application, however, can be difficult. For example, one way of imparting curvature to a set of resin panels in a structure is to create a frame, such as a wood or steel frame that is configured with curving corresponding to formations in a set of resin panels. In some cases, the manufacturer may even create a frame that, when the resin panel is positioned within the frame, causes the resin panel to flex into a particular conformation. Constructing such frames, however, can be difficult, if not prohibitively expensive for relatively complex curvatures. In particular, even slight mismatches in frame design and resin panel formation can result in stress and/or cracking of the resin panel.

Other conventional solutions for mounting resin panels to a structure (e.g., wall, ceiling, or corresponding frame) include using one or more standoffs. In particular, the conventional standoff positions a resin panel at a "standoff" position with respect to the wall, where the standoff position is a distance defined generally by a length of a portion of the standoff (i.e., the standoff barrel). To use a standoff, the manufacturer will perforate several portions of the resin panel to create mounting interfaces. The manufacturer can then insert a portion of the stand off barrel (or a portion of an opposing cap) through the perforation to secure the resin panel.

Such mounting hardware however, can stress the resin panel, particularly if the panel is flat, but is intended to be flexed or bent in some way so as to be mounted as part of a non-linear structure. This is partly since it is impractical to produce specifically-shaped mounting hardware for each possible non-linear mounting interface in the resin panel. In particular, creating special mounting hardware can be laborious, and can negatively impact the speed by which a manufacturer can process and assembly specific types of resin panel applications for customers.

As a result, the same mounting hardware tend to be used for all mounting interfaces on the resin panel. In most cases, this means that a manufacturer is using mounting hardware that may in many cases present a relatively rigid, non-linear mounting interface that does not match other non-linear portions of the resin panel. Coupled with the resin panel's weight, this mismatch in shape between the mounting hardware and the resin panel, particularly at a curved portion of the resin panel, can stress, crack, or ruin the panel, and destroy the intended aesthetic. Also, hardware to panel mismatch can distort desired panel geometry to non-conforming shapes.

Along these lines, mounting hardware such as the aforementioned also tend to create aesthetic problems in that they tend to be visible. In particular, using a standoff that mounts through a perforation of the resin panel generally means that at least a portion of the standoff will be visible after mounting the resin panel as part of a structure. Although the assembler may choose standoff hardware that has an aesthetically pleasing finish, the mounting hardware is nevertheless at least partly visible, and many designers would otherwise prefer that the mounting hardware be completely concealed. Similarly, resin panels are often used for backlit applications due to the translucent nature of the material. Unfortunately, even if concealed behind the resin panel, conventional mounting hardware tends to have a fairly pronounced shadow footprint, which is undesired as it takes away from the intended aesthetic of the resin panel.

Accordingly, there are a number of disadvantages with present resin mounting hardware that can be addressed, particularly as relates to mounting curved structures.

BRIEF SUMMARY OF THE INVENTION

Implementations of the present invention provide systems, methods, and apparatus configured to mount panels, such as resin panels, in a wide variety of positions and/or orientations pursuant to assembling a curved structure. In particular, implementations of the present invention relate at least in part to hardware that can be readily adjusted and re-used to mount panels in a wide range of shapes and/or orientations as part of a structure without imparting undue stress to the resin panel. Such hardware can be used to mount or otherwise create a wall, ceiling, or floor structure in a manner that does not readily expose the mounting hardware to an observer.

For example, a low-profile, flexible mounting bracket configured to mount one or more substantially linear panels to a non-linear support structure can include a proximal component having one or more attachment interfaces configured to attach to a support structure. The flexible mounting bracket can also include a distal component having one or more mounting interfaces configured to mount the distal component to a panel surface. The proximal component and the distal component are configured to flexibly pivot with respect to each other before and after being mounted to both to the support structure and to the panel surface.

In addition, a system for mounting one or more substantially linear panels to one or more non-linear support structures in a manner that imparts a non-linear formation to the one or more linear panels can include a support structure having at least a support beam. The system can also include a plurality of different horizontal support bars of differential length, the plurality of different horizontal support bars being attached on at least one end to the support beam. In addition, the system can include a mounting plate attached to each of the horizontal support bars on an opposing end, wherein the differential lengths of the plurality of different horizontal support bars cause the mounting plate to be angled or curved with respect to the support beam.

Furthermore, the system can include a plurality of flexible mounting brackets attached via an attachment interface on one end to the mounting plate. The plurality of flexible mounting brackets are configured such that a substantially linear resin panel conforms to the angled or curved formation of the mounting plate when mounted thereto.

In addition, a curved panel structure in accordance with the present invention can include a plurality of substantially linear panels, where the plurality of panels maintain a substantially linear shape in an non-mounted position. The curved panel structure can also include a plurality of vertical support structures comprising a corresponding plurality of support beams, as well as a plurality of mounting plates attached to the plurality of support beams such that the plurality of mounting plates maintain a non-linear formation. In addition, the curved panel structure can include a plurality of flexible pivoting mounting brackets attached to each of the plurality of mounting plates on one end, and at least one of the plurality of panels on an opposing end. The plurality of panels conform to and maintain a non-linear shape.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention extend to systems, methods, and apparatus configured to mount panels, such as resin panels, in a wide variety of positions and/or orientations pursuant to assembling a curved structure. In particular, implementations of the present invention relate at least in part to hardware that can be readily adjusted and re-used to mount panels in a wide range of shapes and/or orientations as part of a structure without imparting undue stress to the resin panel. Such hardware can be used to mount or otherwise create a wall, ceiling, or floor structure in a manner that does not readily expose the mounting hardware to an observer.

In general, the panels illustrated and/or described herein for use with the present invention can comprise any type of solid panel material, including both resin or glass sheets. For example, the panel material composition in at least one implementation is such that the panel can be bent a sufficient degree without undue stress. In some cases, this will mean that the panel can include glass materials, while, in other cases, this will mean that the panel will include resin materials, such as polycarbonate, acrylic, and/or copolyesters such as PETG, PCTG, or the like. The following description, however, describes the mounting hardware of the present invention primarily with respect to resin panels for purposes of convenience in describing at least one implementation.

Figure 1:
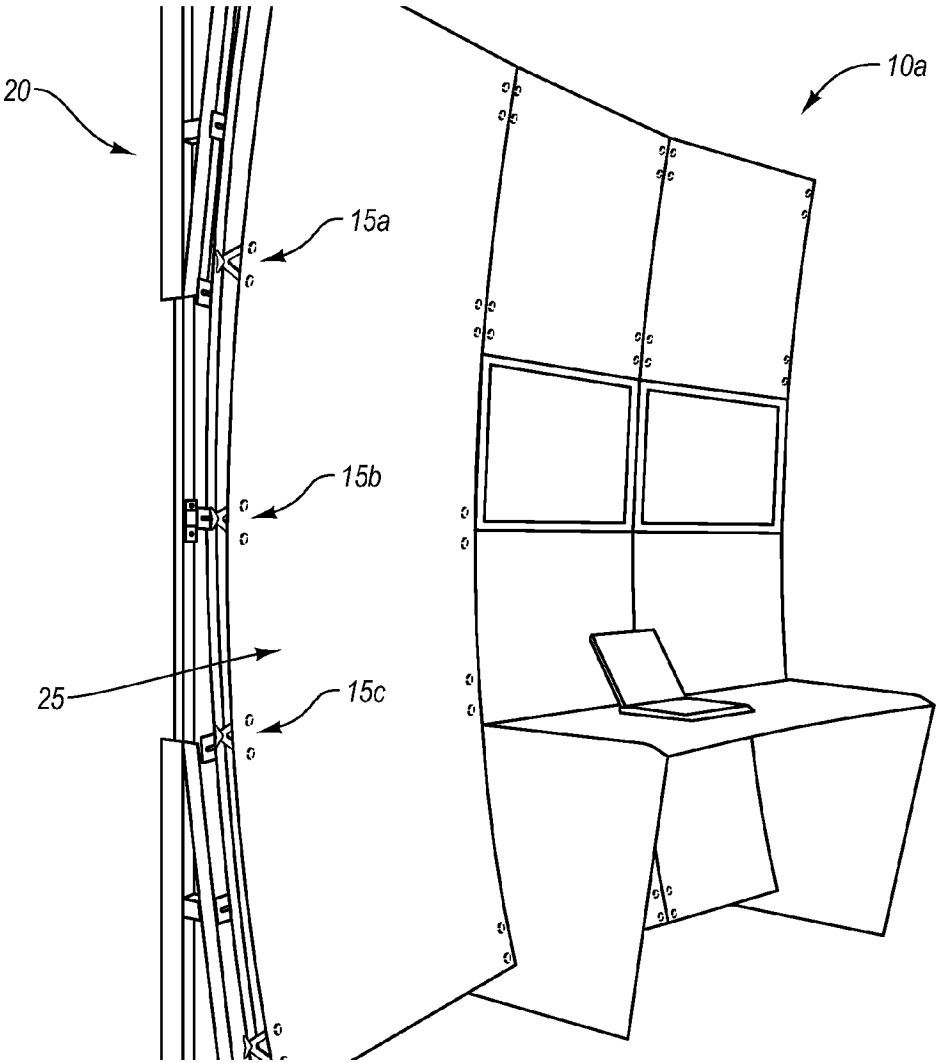
FIG. 1 illustrates a side perspective view of a curved wall structure in which mounting hardware in accordance with an implementation of the present invention is used to mount a plurality resin panels in a curved structure.

FIG. 1 illustrates a side perspective view of a curved wall structure that has been assembled using non-linear support hardware as well as flexible mounting brackets in accordance with an implementation of the present invention. In particular, FIG. 1 illustrates a curved wall structure 10*a*, which has been assembled at least in part using support structure 20 having one or more flexible mounting brackets 15(*a-b*) attached thereto, and one or more resin panels further mounted to the flexible mounting brackets 15. Since the support structure and flexible mounting brackets are aligned along a non-linear plane, FIG. 1 shows that the resin panels 15 mounted thereto flex, and otherwise curve in conformation with the non-linear plane.

In a side view, FIG. 1 shows in this particular case that at least some of the flexible mounting brackets 15 may be exposed. Nevertheless, from a facing view, FIG. 1 shows that at least one advantage of the present invention is that the flexible mounting brackets 15 can provide a non-linear mounting interface that is otherwise hidden behind the mounted resin panels 25. In addition, FIG. 1 shows that each flexible mounting bracket 15, which is the same design, is attached along a different angle of the support structure 20. For example, flexible mounting bracket 15*a* is mounted at one position and angle of a non-linear attachment interface of support structure 20, while flexible mounting bracket 15*b* is mounted at another position and angle. Similarly, flexible mounting bracket 15*c* is mounted at a different position and angle, and so on. As will be understood more fully herein, therefore, the same design of flexible mounting bracket 15 can be used at a plurality of different positions, angles and orientations, yet still maintain a substantially even, flexible mounting interface with a resin panel 25 in a non-linear mount.

Figure 2:
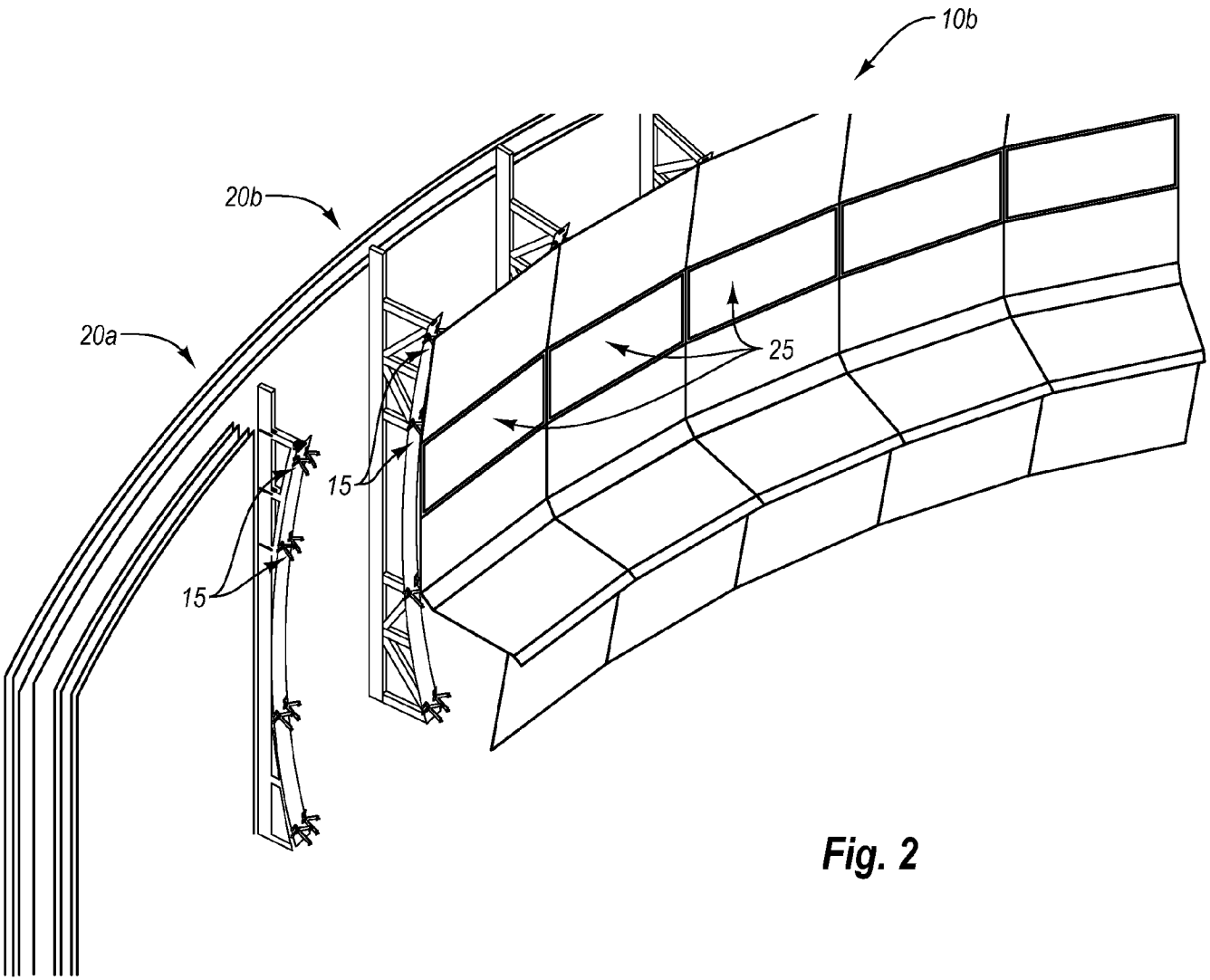
FIG. 2 illustrates a top perspective view of a curved wall structure in the process of being created using the mounting hardware of FIG. 1.

FIG. 2 illustrates a top perspective view of another wall structure 10*b*, prepared using the same or similar support structures 20 shown in FIG. 1. In particular, FIG. 2 shows that a curved wall structure 10*b* can comprise a plurality of different support structures 20 to mount each of the resin panels 25 together. In general, there can be any number or orientation of these support structures 20 to create virtually any type of wall, ceiling, or floor structure (or corresponding geometry thereof). For example, FIG. 2 shows that a concave wall structure 10*b* of virtually any length can be made simply by adding additional, consecutive concave-shaped support structures 20.

In addition, although FIG. 2 shows that the resin panels 25 in this case have been mounted as one type of curved wall 10*b* (i.e., concave), one will appreciate that the manufacturer can additionally or alternatively modify the shape or orientation of the attachment interfaces (e.g., plate 45, FIG. 3) to create other types of curved structures (of virtually any geometry), such as ceilings, floors, or even treatments thereto. For example, a manufacturer could configure support structure 20*a* with one level of curvature (concave or convex), and alternatively configure support structure 20*b* with another level of curvature. In either case, the resin panels 25 mounted to each of the different vertical support structures (i.e., via the correspondingly attached flexible mounting brackets) will then bend or flex in line with the support structures 20. Importantly, the resin panels 25 will mount to these support structures without the otherwise accompanying stress that could crack or damage the given panel 25, or that can otherwise deform a desired geometry in the resin panels 25.

Figures 3A, 3B:
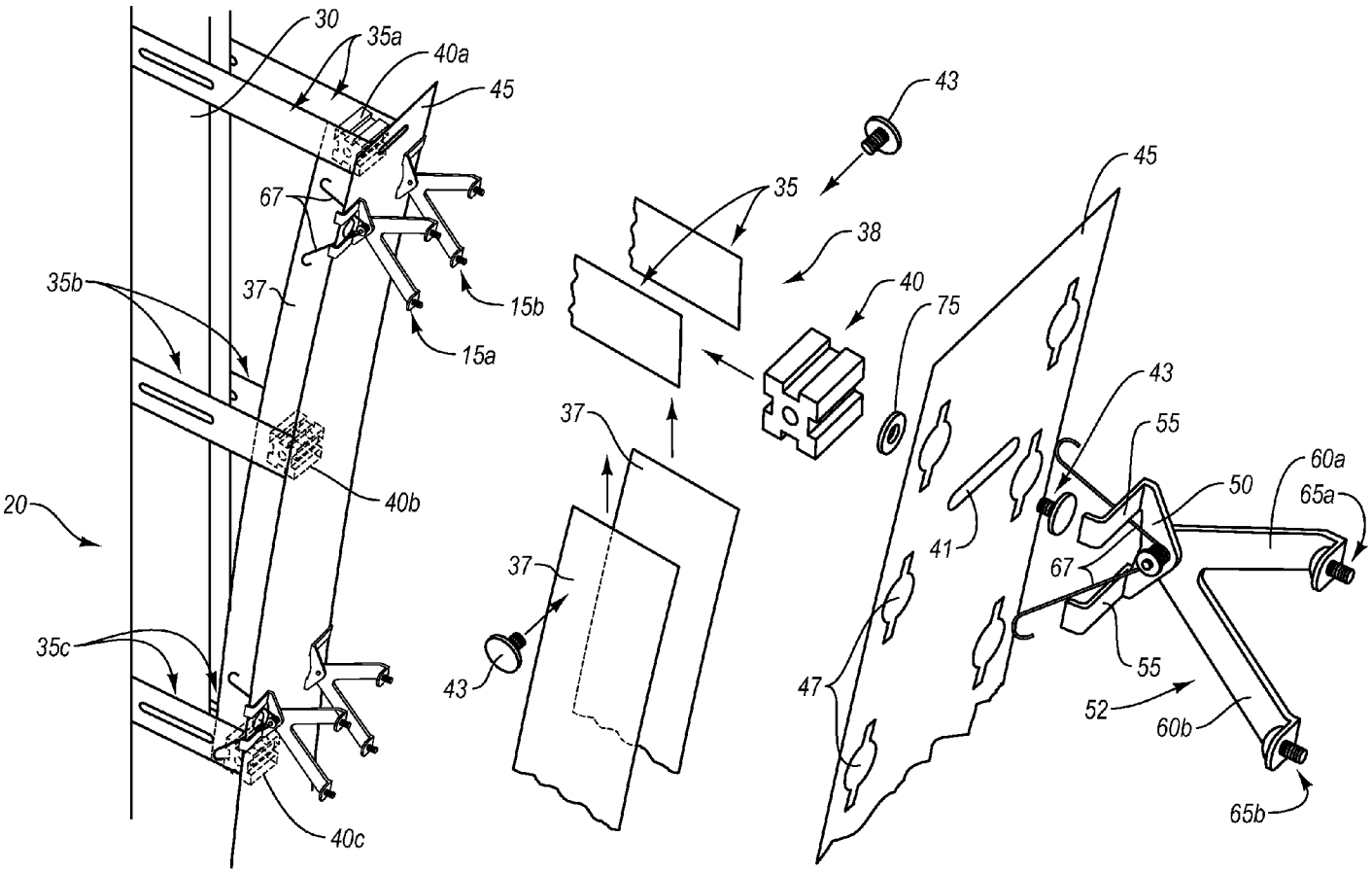
FIG. 3A illustrates a side perspective view of components in a support structure used to prepare and mount a curved wall structure in accordance with an implementation of the present invention.
FIG. 3B illustrates an exploded view of the components shown in the ado support structure of FIG. 3A.

For example, FIG. 3A illustrates how a manufacturer can adjust shapes and orientations of the support structures 20 to ultimately adjust the shape or orientation of the resin panels 25. In particular, FIG. 3 shows that at least one implementation of a support structure 20 comprises a support beam 30, and can further comprise a number of sets of horizontal support bars 35*a*, 35*b*, 35*c* mounted or attached thereto. FIG. 3A further shows that each set of horizontal support bars 35(*a-c*) in this implementation is of a different length from the next set of horizontal support bars. For example, FIG. 3A shows that the set of horizontal support bars 35*a* is longer than the set of horizontal support bars 35*b*, and so on. In the illustrated implementation, therefore, FIG. 3A shows that the manufacturer has positioned each set of horizontal support bars 35 according to sequential length from top to bottom (depending on orientation) along support beam 30. This creates a curved or angled plane.

For additional support, FIG. 3A also shows that each horizontal support bar 35 can be configured to additionally mount to a mounting plate 45 via one or more mounting blocks 40*a*, 40*b*, 40*c*, etc. Furthermore, and though this is not necessarily required, FIG. 3A also illustrates an implementation in which the manufacturer has mounted one or more diagonal support members 37 to each of the horizontal support members 35. In particular, FIG. 3A shows each horizontal mounting bar 35 is coupled with (or otherwise configured to receive) one or more diagonal (or vertical) support bars 37. One will appreciate that this additional, diagonal support bar 37 can provide still additional mounting stability in support structure 20 by stabilizing the orientation of the horizontal supports 35.

In addition, FIG. 3A shows that the sets of horizontal support bars 35 and diagonal support bars 37 can be coupled together with mounting block 40. In particular, FIG. 3A shows that mounting block 40 is configured to be inserted in a cavity 38 formed between horizontal support bar 35 and diagonal support bar 37. As shown in FIG. 3B, for example, a manufacturer can prepare this assembly by first inserting or otherwise positioning a set of one or more diagonal support bars 37 between or about the horizontal support bar(s) 35, such as after mounting horizontal support bar 35 to vertical support beam 20. The sets of horizontal support bars 35 and diagonal support bars 37 form a cavity 38 for receiving mounting block 40. The manufacturer can then secure the sets of diagonal support bar(s) 37 and horizontal support bar(s) 35 together with mounting block 40 using corresponding one or more fasteners 43.

By way of explanation, it is not required that the horizontal support bar(s) 35 and diagonal/vertical support bar(s) 37 be individually distinct components, such as illustrated. For example, a manufacturer may use a single horizontal support bar of virtually any type of geometry at any given vertical position on support beam 30. In addition, the manufacturer could simply cut, weld, or otherwise form both the horizontal and diagonal/vertical support bars 35, 37 as a single unitary piece. Along these lines, the manufacturer could assemble and attach the horizontal and diagonal support bars 35, 37 together, and then weld them. Alternatively, the manufacturer could cut two opposing sheets that each comprise the horizontal/diagonal support bars as a unitary material positioned on opposing sides of support beam 30.

In any event, FIG. 3A further shows that the sets of horizontal support bars 35 and/or diagonal support bars 37 (combined or individual components) can be coupled to a mounting plate 45. Due in this case to the orientation and dimensions of horizontal support bars 35, FIG. 3A also shows that mounting plate 45 in this case flexes or otherwise bends to form a curved interface structure. In this particular case, this flexing/bending of plate 45 results in a substantially concave surface, although one will appreciate as previously described herein that virtually any type of geometry can be created depending on the length and orientation of horizontal support bars 35. One will appreciate that such formations can be enabled by or otherwise due at least in part to the flexibility of mounting plate 45, which can comprise any number of sufficiently rigid metal, plastic, or composite materials that are sufficiently flexible to be bent into and otherwise maintain a particular position.

To illustrate this assembly, FIG. 3B shows that the manufacturer can secure mounting plate 45 to each of the sets of horizontal support bar(s) 35 and diagonal support bar(s) 37 via one or more mounting blocks 40, as needed. For example, FIG. 3B shows that mounting plate 45 comprises one or more slits or perforations 41 for receiving one or more fasteners 43. The manufacturer can thus position the perforated portion of mounting plate 45 against a given mounting block 40, which is already used to fasten or otherwise secure the sets of diagonal and horizontal support bars 37 and 35, respectively. The manufacturer then secures mounting plate 45 against mounting block 40 using fastener 43, which thus holds mounting plate 45 in position against horizontal support bar 35 and/or diagonal support bar 37. If desired, the manufacturer may also secure other portions of the mounting plate 45 directly to another portion of diagonal support bar 37. In any event, FIG. 3A shows that attaching mounting plate 45 to support structure 20 creates in this case a curved, albeit uniform, mounting interface for the flexible mounting brackets 15.

Along these lines, FIG. 3A also shows that the manufacturer can mount one or more flexible mounting brackets 15 along the curved formation of the mounting plate 45. In the illustrated case, the manufacturer has mounted a plurality of different, flexible mounting brackets 15 at approximately the same vertical position on mounting plate 45. This, however, is not required, and the manufacturer could alternatively mount more or fewer flexible mounting brackets 15 per vertical position on mounting plate 45, such as may be needed to mount a resin panel 25. In either case, each mounting bracket 15 in each position is the same style and configuration of mounting bracket as the next one used throughout the system of a given structure (e.g., 10). This is possible because, as discussed more fully below, each flexible mounting bracket 15 is configured to swivel, flex, or otherwise adjust to accommodate a number of different mounting interface angles.

To mount the flexible mounting bracket 15 into position, FIG. 3B, shows that the manufacturer first positions the flexible mounting bracket 15 against the mounting interface 45. For example, the manufacturer flexes torsion spring 66 extensions 67 together, and positions the attachment interface members 55 so that the extensions 67 fit within plate perforation 47. In addition, the manufacturer positions the attachment interface members 55, which extend perpendicularly from a proximal component 50 of flexible mounting bracket 15, directly against an appropriate position of the mounting plate 45. In one implementation the torsion spring extensions 67 flex back out within the perforations 47 to substantially maintain the corresponding bracket 15 in place on plate 45.

In additional or alternative implementations, however, the manufacturer can also secure the one or more attachment interface members 55 to the mounting plate 45 via one or more fasteners. For example, the manufacturer can tap both the interface members 55 and mounting plate 45, if they are not already-pre-drilled or pre-tapped. Upon tapping or otherwise aligning the taps/perforations, the manufacturer can then insert the one or more fasteners through the tappings in interface members 55, and secure the flexible mounting bracket 15 to the mounting plate 45. Once the flexible mounting bracket(s) 15 is/are in position, the manufacturer can then mount (or begin mounting) the resin panels 25 to the flexible mounting brackets 15.

Figure 3C:
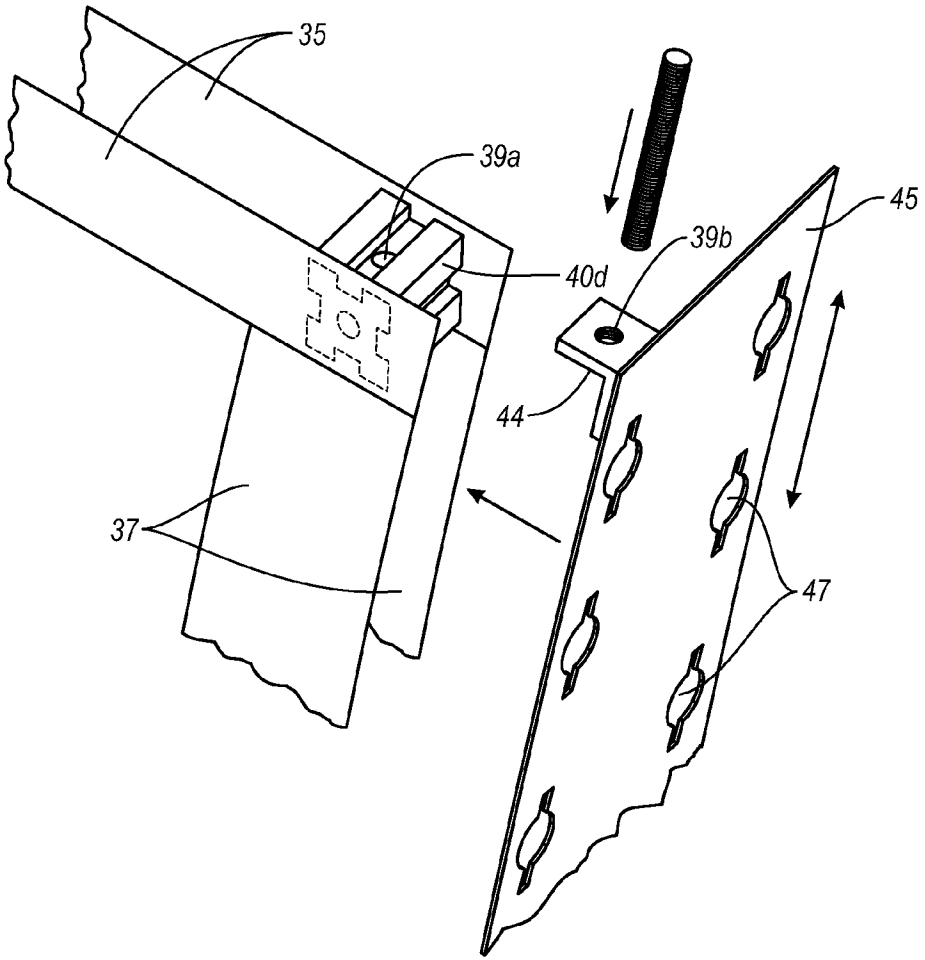
FIG. 3C illustrates an exploded view of an alternative implementation for assembling and adjusting one or more of the components shown in FIGS. 3A and 3B.

FIG. 3C illustrates an additional or alternative implementation for assembling the sets of horizontal and diagonal support bars 35, 37 using an adjustable mounting block 40*d*. As understood more fully below, the adjustable mounting block 40*d* assembly can be used to adjust mounting plate 45 with respect to the support bars 35, 37. For example, FIG. 3C shows that mounting block 40*d* can be assembled together with one or more block adjusters 44. As shown, the manufacturer assembles the horizontal and diagonal/vertical support bars 35, 37 as before with mounting block 40*d*. In this case, however, mounting block 40*d* further comprises an adjuster tap 39*a*, which is used to receive a threaded (or otherwise adjustable) adjuster rod 49. The adjuster rod 49, in turn, is also assembled through block adjuster 44, which comprises its own adjuster tap 39*b*

In assembly, therefore, FIG. 3C shows that the manufacturer attaches one or more block adjusters 44 to the mounting plate 45. The manufacturer further aligns the mounting plate 47 and block adjuster 44 above or about the adjuster tap 39*a* of mounting block 40*d*. In addition, the manufacturer inserts adjuster rod 49 through adjuster taps 39*a-b*, and twists or otherwise adjusts the adjuster rod 49 so that block adjuster 44, and correspondingly plate 45, moves with respect to mounting block 40*d*. For example, the adjuster tap 39*a* of mounting block 40*d* may be non-threaded, but nevertheless receive an end of adjuster rod 49 at a fixed length within block 39*a*. By contrast, the adjuster tap 39*b* in block adjuster 44 may, however, be threaded with reciprocal threads that are reciprocal with threads on adjuster rod 49.

Thus, twisting adjuster rod 49 in such an implementation can cause block adjuster 44 to move up or down adjuster rod 49, and thus move up or down with respect to mounting block 39*a*. The manufacturer can then continue this adjustment until plate 45 is in an appropriate or desired position with respect to the horizontal and diagonal/vertical support bars 35, 37. For example, the manufacturer may move the mounting plate 45 upward or downward to adjust the position of mounting brackets 15, and or to adjust the curvature or alignment of mounting plate 45 (and ultimately resin panel(s) 25).

By way of explanation, FIGS. 1-3C (as well as 4A-4B) generally illustrate mounting plate 45 as a single, unitary sheet or component upon which one or multiple mounting brackets 15 are attached at a particular vertical position. One will appreciate, however, that mounting plate 45 can comprise a plurality of different mounting plates positioned side-by-side, but otherwise attached to opposing support bars 35, 37 that flank support beam 30. In particular, and with reference to FIG. 3C, one horizontal support bar 35 and diagonal support bar 37 could be connected with a first mounting block 40*d* and block adjuster 44, while a second horizontal support bar 35 and diagonal support bar 37 are connected to a second mounting block 40*d* and block adjuster 44.

Thus, rather than having two flexible mounting brackets 15*b*, 15*d* mounted on the same mounting plate 45, the two flexible mounting brackets 15*b*, 15*d* could be adjustably mounted on adjacently positioned, but separate, mounting plates 45 (not shown). With respect to the adjustment components shown in FIG. 3C, one will appreciate that such a configuration can provide still further adjustability even between two different mounting brackets positioned at essentially the same vertical position with respect to support beam 30. This can be particularly true when the two mounting brackets 15*b* and 15*d* are connected to different resin panels (e.g., 25*a*, 25*b*, FIG. 4 A). In particular, such separation can provide the manufacturer with the ability to vertically (as appropriate) adjust two different mounting plates 45, and hence two different resin panels, attached to the same support beam 30.

Figures 4A, 4B:
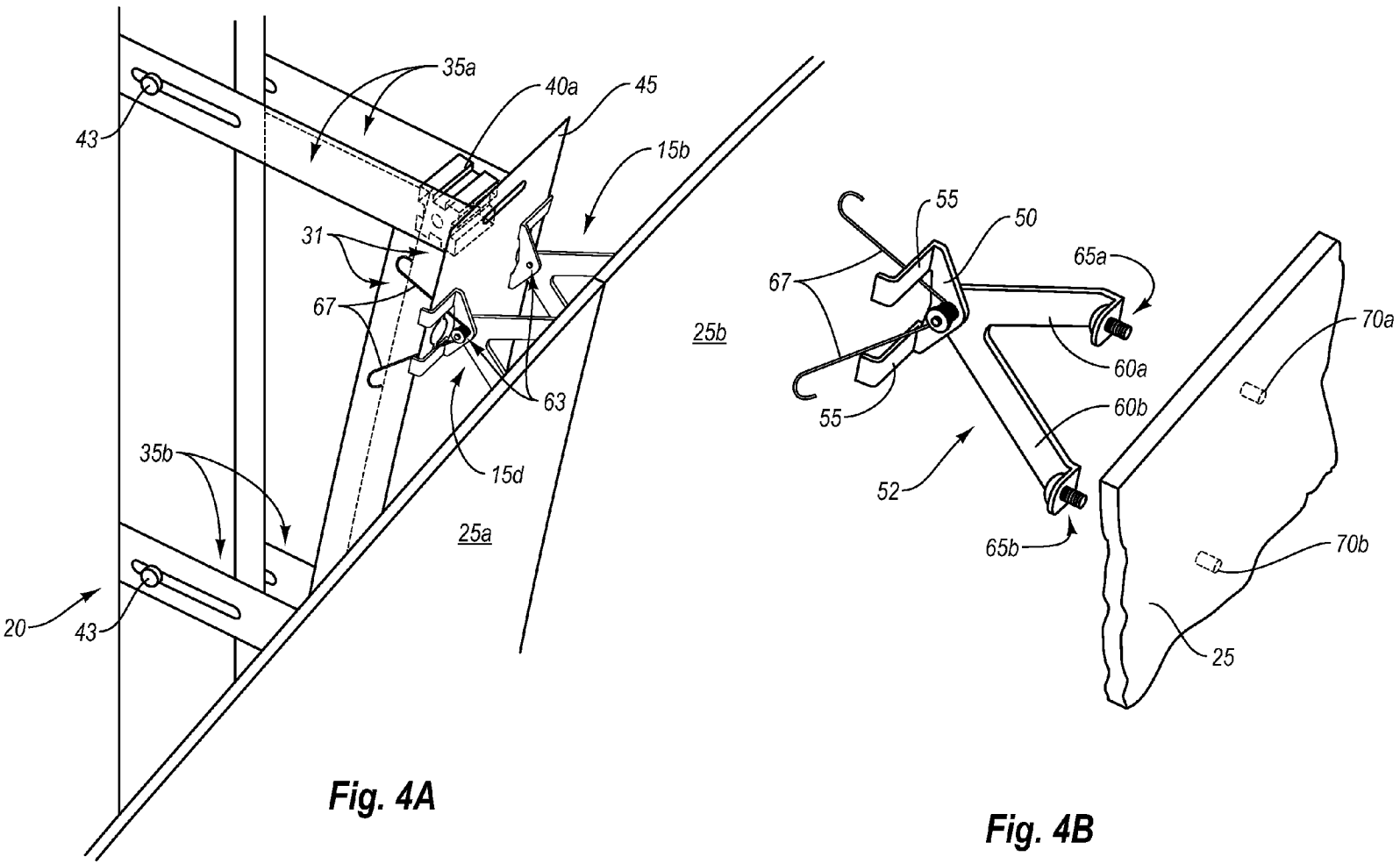
FIG. 4A illustrates a top perspective view of the components in the support structure shown in FIG. 3A when a resin panel is mounted thereto.
FIG. 4B illustrates an exploded view of the components shown in FIG. 4A prior to assembly.

FIG. 4A illustrates a top perspective view of the flexible mounting brackets 15 shown in FIGS. 1 and 2, particularly when the flexible mounting brackets 15 have been mounted to one or more resin panels 25. In this case, FIG. 4A shows that two flexible mounting brackets 15*a* and 15*d* are mounted directly and side-by-side at the same vertical position into two different resin panels 25(*a-b*). One will appreciate, however, that other mounting arrangements are possible, and may even be desirable depending on the shape, orientation, or position of the intended wall (e.g., 10*a-b*). For example, one flexible mounting bracket (e.g., 15*a*) may be mounted to two different resin panels 25 since flexible mounting bracket 15 can comprises at least two mounting interfaces 65(*a-b*). Such an arrangement may be used to minimize the effect of a seam between the two different resin panels 25. Furthermore, a manufacturer might mount multiple flexible mounting brackets 15 along the same resin panel (e.g., 25), particularly when using larger, heavier resin panels.

FIG. 4B illustrates an exploded view of the mounting hardware described herein as it can be used to connect or otherwise mount one or more resin panels 25. For example, FIG. 4B shows that the flexible mounting bracket 15 can comprise a plurality of mounting interfaces 65(*a-b*) that extend from one or more mounting arms 60. In at least one implementation, the plurality of mounting interfaces 65 each comprise one or more threaded members that extend outwardly. To mount the resin panel 25 to the mounting interfaces 65, therefore, the manufacturer can form reciprocal taps 70*a-b* in resin panel 25 for receiving the threaded portions of interfaces 65.

In at least one implementation, the manufacturer forms these taps 70*a-b* only through a portion of the width/gauge of resin panel 25, rather than completely through the resin panel 25. In other words, the taps 70*a-b* in such a configuration would not extend through resin panel 25 as full perforations. As such, a manufacturer can mount the resin panel 25 to the mounting interfaces 65 by rotating the threaded portions of mounting interfaces 65 into the corresponding taps 70*a-b* until there is a sufficiently secure fit.

In additional or alternative implementations, however, the manufacturer can form taps 70*a-b* completely through the gauge of resin panel 25 to form a complete perforation. For example, a manufacturer could secure the resin panel 25 directly to the mounting interfaces 65 using one or more end or mounting caps (not shown) that screw into or around a threaded (or reciprocally threaded) portion of mounting interface 65. Although such a configuration will typically mean that a portion of the mounting interface 65 may be exposed outside of the resin panel 25, there may be other reasons for taking this approach.

For example, using fairly wide taps 70*a-b* can be useful to provide at least some space between the flexible mounting bracket 15 itself and the resin panel 25. Such clearance can prevent any imperfections in the flexible mounting bracket 15 from transferring to the suspended panel 25, or interfering with the intended shaping of the overall structure 10*a-b*, particularly with complex geometric patterns. Accordingly, one will appreciate that the illustrated implementation shown in FIG. 4B is only one way of attaching the resin panel(s) 25 to bracket(s) 15.

Figure 5:
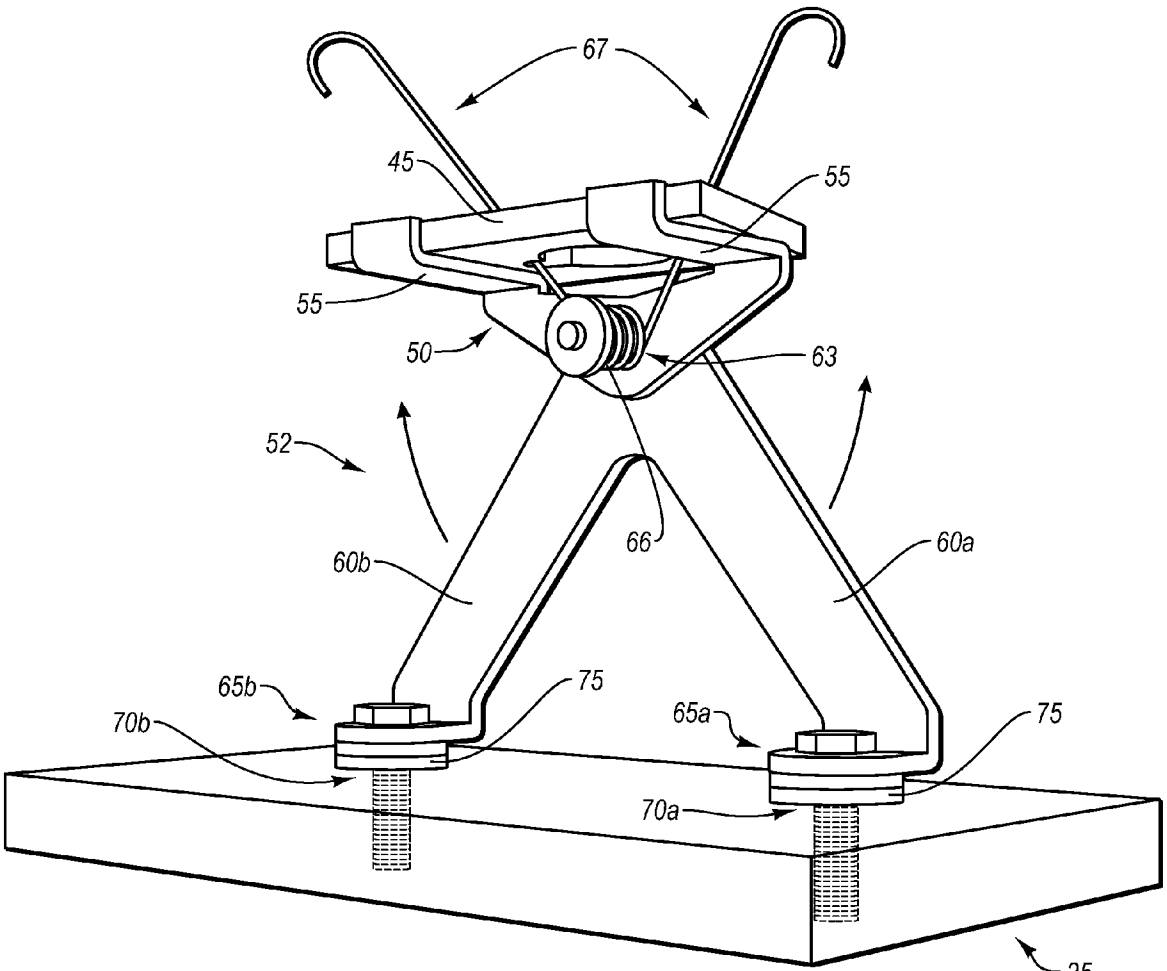
FIG. 5 illustrates a close-up perspective view of the flexible mounting bracket shown in FIGS. 1 through 4B.

FIG. 5 illustrates a more detailed perspective view of the flexible mounting bracket 15 used to mount one or more resin panels 25. As shown, and as previously mentioned with respect to FIGS. 1-4B, at least one implementation of a flexible mounting bracket 15 comprises two main components 50 and 52 that are aligned essentially within the same plane. These components 50, 52 are referred to herein as a "proximal" component 50 and a "distal" component 52 with respect to the mounting plate 45 on which it is (or they are) attached.

In general, both of the proximal and distal components 50, 52 can comprise any sufficiently rigid material for maintaining attachment with mounting plate 45, and for holding a resin panel 25 at the mounting interface portion (e.g., taps 70*a-b*). In one implementation, for example, components 50, 52 comprise extruded aluminum for purposes of strength. In additional or alternative implementations, components 50, 52 can comprise extruded steel with zinc coatings. In addition, both of the proximal and distal components 50, 52 can be formed to also maintain a low profile. For example, FIGS. 1-4B show that the proximal and distal components 50, 52 are not only relatively thin, but also in this particular implementation "v-shaped."

In addition, one will appreciate that the v-shape of components 50, 52 (i.e., formation of mounting arms 60) can provide sufficient mounting strength for holding multiple portions of resin panel 25. This is particularly the case when the "v" of components 50, 52 is aligned along a vertical plane, such as illustrated in FIGS. 1-2. One will appreciate, however, that other shapes and designs can be used to maintain a low profile yet provide sufficient mounting strength. For example, the mounting arms 60 can be formed or cut for any desired length or shape to match any particular shape desired in the resin panel 25. In addition, the mounting interfaces 65 (i.e., nearest the given resin panel(s)) can be cut or otherwise formed to match a variety of different resin panel 25 profiles, including convex or concave profiles.

With respect to maintaining a low profile, one will appreciate that the v-shape of components 50, 52 can be particularly suited to maintaining a low profile when considering mounts with translucent resin panels 25. For example, a manufacturer may desire to position one or more light sources and/or one or more decorative elements behind the mounted resin panels 25. The v-shapes, as well as the relative thinness of the proximal and distal components 50, 52 can help minimize visible shadowing effects that might otherwise be present in such cases.

In addition, and as discussed throughout this specification, an important feature of the mounting bracket 15 is its "flexibility." In at least one implementation, this flexibility is accomplished by mounting the two v-shaped components together in a pivotal fashion using one or more pivot components 63. For example, FIG. 5 shows that the proximal component 50 and distal component 52 can be pivotally connected together at a pivot point 63 with one or more torsion springs 66. In at least one implementation, the one or more torsion springs 66 help provide a flexible, variable, and accommodating mounting interface between the vertical support structure/support frame 20 and the resin panel(s) 25.

At least partly as a result of this torsion spring 66, the distal component 52 can twist with respect to the proximal component 50. The flexibility afforded from such twisting can provide the mounting bracket 15 with a number of advantages. In one implementation, for example, the ability to reflexively twist or flex can minimize the effect of weight or other stresses presented at the mounting interfaces 63, which may be enhanced due to flexing in the resin panel 25, or due to imperfections in curvature from one support structure 20 to the next (e.g., between 20*a* and 20*b*). Furthermore, use of the pivot 63 and torsion spring 66 actions can allow the flexible mounting bracket 15 to be useable (and re-usable) for a wide variety of different wall structure (e.g., 10*a-b*) shapes.

In addition to the flexibility between proximal and distal components 50, 52, other components can be used to accommodate variations at the mounting interface with resin panel 25. For example, FIG. 5 further shows that mounting interfaces 65*a-b* can be further mounted within taps 70*a-b* of panel 25 using one or more spacers or washers 75. The spacers 75 can comprise any number of rigid or flexible materials, including both opaque and transparent/translucent materials, as desired. In one implementation, for example, the spacers 75 comprise translucent polymeric materials in order to minimize the profile behind the resin panels 25.

Accordingly, one will appreciate that the flexible mounting bracket 15 allows one or more resin panels 25 to be easily added and removed in a particular position. As previously mentioned, for example, a manufacturer can easily position one or more light sources behind the resin panel 25 of a given wall structure 10*a-b* due to the provided "standoff" position. In other cases, the manufacturer may position one or more other components behind a translucent panel 25 for any other desired aesthetic ends. This standoff position and relatively simple mounting interface further allows a manufacturer or end user to easily access and change a light source (or other object behind panel 25), such as by direct access through the standoff position, or by easily removing resin panels 25 before such access. This ability to remove resin panels 25 and/or replace the resin panels can be particularly useful where a fire and/or acoustic wall may be positioned between two different, opposed resin walls 10*a-b*.

As such, the inventive flexible mounting brackets and corresponding support structures can efficiently hold otherwise non-linear (albeit partially flexible) panels in relatively complex shapes during and after installation. This ability to hold a particular curved shape with the same mounting bracket throughout the installation can provide significant reductions of labor, such as by eliminating the need for constructing complex frames, or building several differentially-shaped mounting brackets. Such components can make installation of a wide range of panel curvatures and designs much easier, at least in part by reducing or minimizing the effect of imperfections in the supporting framework. Furthermore, these components are aesthetically desirable at least in part by minimizing the visible footprint of the mounting hardware without otherwise sacrificing mounting stability.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A low-profile, flexible mounting bracket configured to mount one or more substantially linear panels to a non-linear support structure, such that the one or more panels conform to the shape of the non-linear support structure without undue stress, comprising:

a proximal component having a v-shape including a first apex and one or more attachment interfaces configured to attach to a support structure;

a distal component having a v-shape including a second apex and one or more mounting interfaces configured to mount the distal component to a panel surface; and one or more springs securing the proximal and distal components together;

wherein the first apex of the proximal component and the second apex of the distal component are pivotally secured together, whereby the proximal component and the distal component are configured to flexibly pivot with respect to each other before and after being mounted both to the support structure and to the panel surface.

2. The low-profile, flexible mounting bracket as recited in claim 1, wherein the one or more mounting interfaces of the distal component are threaded.

3. The low-profile, flexible mounting bracket as recited in claim 1, wherein:

the proximal and distal components are pivotally mounted together in the same plane via the one or more springs; and the plane is substantially perpendicular to both the attachment interfaces and to the mounting interfaces.

4. The low-profile, flexible mounting bracket as recited in claim 1, wherein:

the one or more springs comprise a plurality of spring extensions that extend from the pivotal mounting between the proximal and distal components; and the plurality of spring extensions are configured to maintain a position of the flexible mounting bracket with respect to a mounting plate.

5. The low-profile, flexible mounting bracket as recited in claim 4, wherein the plurality of spring extensions extend from the first apex and between a pair of attachment interfaces of the proximal component.

6. The low-profile, flexible mounting bracket as recited in claim 1, wherein the one or more springs comprise a torsion spring.

7. A low-profile, flexible mounting bracket configured to mount one or more panels to a support structure without undue stress, comprising:

a proximal component having a v-shape including a first apex and two or more attachment interfaces extending from the first apex;

a distal component having a v-shape and two or more mounting interfaces extending from the second apex;

one or more springs pivotally connecting the first apex of the proximal component to the second apex of the distal component; and one or more spring extensions configured to bias the proximal component against a support structure;

wherein the one or more springs are configured to pivot the proximal component and the distal component with respect to each other.

8. The low-profile, flexible mounting bracket as recited in claim 7, wherein the one or more spring extensions extend from the one or more springs and between the two or more mounting interfaces.

9. The low-profile, flexible mounting bracket as recited in claim 7, wherein the one or more springs comprise a torsion spring.

10. The low-profile, flexible mounting bracket as recited in claim 7, wherein the proximal component and the distal component are aligned in a parallel configuration.

11. A low-profile bracket configured to mount one or more panels to a support structure without undue stress, comprising:

a proximal component having a first apex and two or more attachment interfaces extending from the first apex, the two or more attachment interfaces being configured to secure the proximal component to a support structure;

a distal component having one or more mounting interfaces configured to mount the distal component to a panel surface; and one or more spring extensions extending from the first apex and between the two or more attachment interfaces;

wherein the one or more spring extensions are configured to maintain the proximal component against the support structure.

12. The low-profile bracket as recited in claim 11, further comprising one or more springs pivotally connecting the first apex of the proximal component to the distal component.

13. The low-profile bracket as recited in claim 12, wherein the one or more springs comprise torsion springs.

14. The low-profile bracket as recited in claim 12, wherein the distal component comprises a second apex and a pair of mounting arms connecting the second apex and a pair mounting interfaces.

15. The low-profile bracket as recited in claim 14, wherein the pair of mounting interfaces extend generally perpendicularly away from the pair of mounting arms.

16. The low-profile bracket as recited in claim 14, wherein the proximal component and the distal component each have a v-shape.

17. The low-profile bracket as recited in claim 14, wherein the second apex of the distal component is secured to the first apex of the proximal component via the one or more springs.

18. The low-profile bracket as recited in claim 11, further comprising one or more taps configured to secure the one or more mounting interfaces to the panel surface.

* * * * *

UNITED STATES PATENT AND TRADEMARK OFFICE

CERTIFICATE OF CORRECTION

PATENT NO. : 7,909,297 B1
APPLICATION NO. : 11/829810
DATED : March 22, 2011
INVENTOR(S) : Harris et al.

It is certified that error appears in the above-identified patent and that said Letters Patent is hereby corrected as shown below:

Drawings

Sheet 4, replace Figure 3C with the figure depicted below, wherein label 49 is labeled as shown below

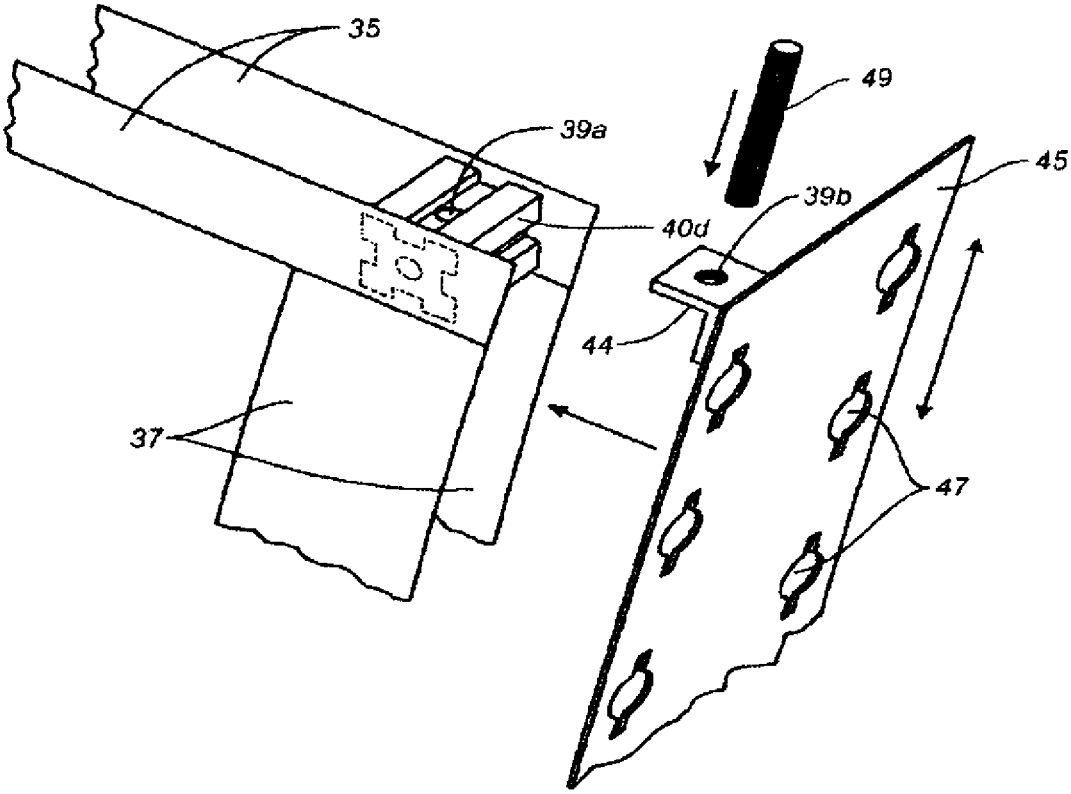

Fig. 3C

Column 2

Signed and Sealed this
Thirteenth Day of March, 2012

David J. Kappos

David J. Kappos
*Director of the United States Patent and Trademark Office*

Line 21, change “assembly” to --assemble--
Line 23, change “tend” to --tends--

Column 3
Line 10, change “to both to” to --to both--
Line 34, change “an” to --a--

Column 7
Line 50, change “already-pre-drilled” to --already pre-drilled--

Column 10
Line 5, change ““v-shaped”” to --are “v-shaped”--

UNITED STATES PATENT AND TRADEMARK OFFICE

CERTIFICATE OF CORRECTION

PATENT NO. : 7,909,297 B2
APPLICATION NO. : 11/829810
DATED : March 22, 2011
INVENTOR(S) : Harris et al.

It is certified that error appears in the above-identified patent and that said Letters Patent is hereby corrected as shown below:

Drawings

Sheet 4, replace Figure 3C with the figure depicted below, wherein label 49 is labeled as shown below

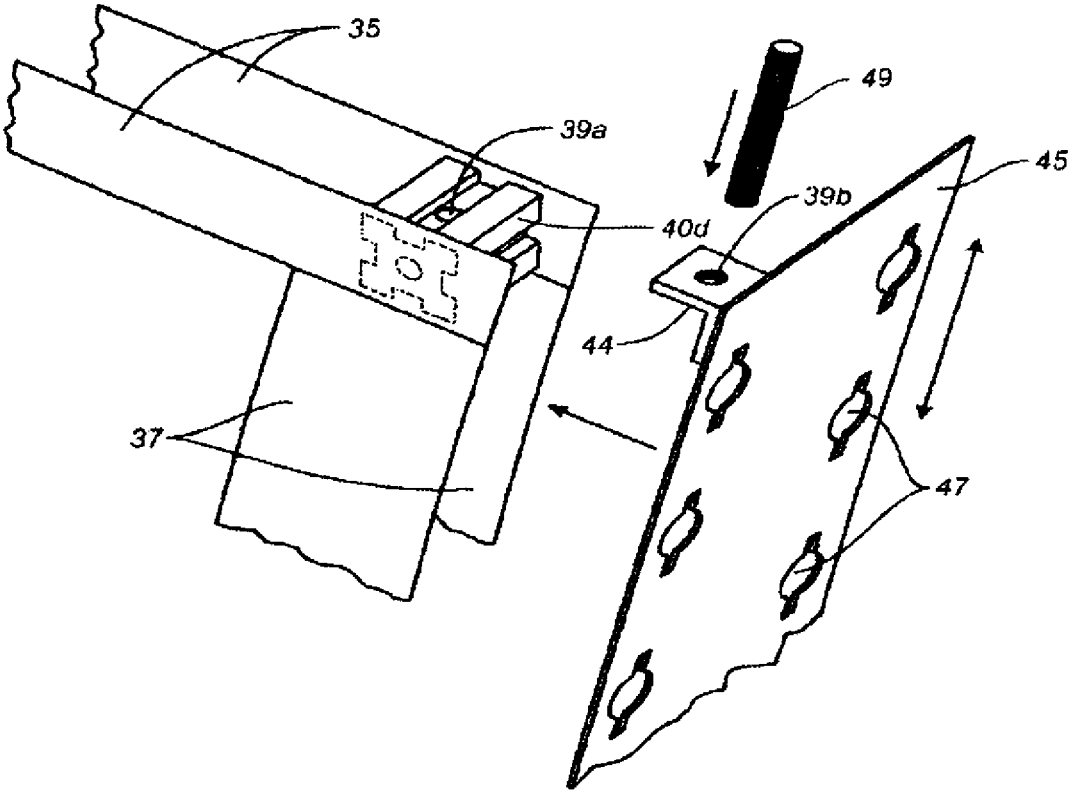

Fig. 3C

This certificate supersedes the Certificate of Correction issued March 13, 2012.

Column 2

Signed and Sealed this
Eighth Day of May, 2012

David J. Kappos

David J. Kappos
*Director of the United States Patent and Trademark Office*

Line 22, change “assembly” to --assemble--
Line 24, change “tend” to --tends--

Column 3
Line 10, change “to both to” to --to both--
Line 34, change “an” to --a--

Column 7
Line 50, change “already-pre-drilled” to --already pre-drilled--

Column 10
Line 5, change ““v-shaped”” to --are “v-shaped”--